US009242288B2

(12) United States Patent
Lin et al.

(10) Patent No.: US 9,242,288 B2
(45) Date of Patent: Jan. 26, 2016

(54) METHOD OF ASSEMBLING THERMAL MODULE

(75) Inventors: Sheng-Huang Lin, New Taipei (TW); Kuo-Sheng Lin, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 550 days.

(21) Appl. No.: 13/560,088

(22) Filed: Jul. 27, 2012

(65) Prior Publication Data

US 2014/0026417 A1 Jan. 30, 2014

(51) Int. Cl.
*B21D 39/06* (2006.01)
*B21D 53/08* (2006.01)

(52) U.S. Cl.
CPC ..... *B21D 39/06* (2013.01); *B21D 53/085* (2013.01); *Y10T 29/4935* (2015.01)

(58) Field of Classification Search
CPC ..... B23P 11/00; B23P 15/26; B23P 2700/09; B23P 2700/10; H01L 21/4882; B21D 53/02
USPC ..... 29/890.03
See application file for complete search history.

(56) References Cited

U.S. PATENT DOCUMENTS

2013/0000872 A1* 1/2013 Lin ..... 165/104.26

* cited by examiner

*Primary Examiner* — Moshe Wilensky

(57) ABSTRACT

A method of assembling thermal module includes steps of providing a first heat dissipation member and a second heat dissipation member, and aiming a section of the first heat dissipation member at a section of the second heat dissipation member, which section of the first heat dissipation member is to be assembled with the section of the second heat dissipation member and driving the first heat dissipation member to connect with the second heat dissipation member by means of striking the first heat dissipation member into the second heat dissipation member. By means of the method, the thermal module can be assembled at higher efficiency. Moreover, the manufacturing process of the thermal module is simplified.

7 Claims, 5 Drawing Sheets

METHOD OF ASSEMBLING THERMAL MODULE

BACKGROUND OF THE INVENTION

1. Field of the Invention

The present invention relates to a method of assembling thermal module. By means of the method, the assembling efficiency of the thermal module is increased.

2. Description of the Related Art

Along with the advance of technologies, the number of transistors per unit area of electronic component has become more and more. Therefore, on one hand, the heat generated by the electronic component in working is increased and on the other hand, the working frequency of the electronic component has become higher and higher. The heat generated when the transistors are switched on/off is also a cause of increase of the heat generated by the electronic component. In case the heat is not dissipated in time, the operation of the chip will be slowed down. In some more serious cases, even the lifetime of the chip will be shortened. To enhance the heat dissipation effect for the electronic component, a heat sink with multiple radiating fins is generally used to dissipate the heat to the environment by way of natural convection or forced convection.

Heat pipe is able to transfer a great amount of heat through a considerable distance under a very small cross-sectional area and temperature difference without using any external power supply. The heat pipe is economically advantageous in that the heat pipe can work without using any power supply and without occupying much room. Therefore, nowadays, various heat pipes are widely applied to all kinds of electronic products as ones of the heat transfer components.

The heat sink, especially the heat sink with heat pipe structure, is the most often used heat dissipation means applied to the heat-generating component. The heat sink is made of a material with high thermal conductivity. The working fluid filled in the heat pipe is able to transfer heat under capillarity. Therefore, the heat sink has a high heat conduction performance. The heat sink is advantageous in that the structure of the heat sink is lightweight and simplified. This can minimize the weight of the heat dissipation device and solve the problems of high cost and complicatedness of the conventional system.

The conventional heat pipe heat sink structure includes multiple radiating fins and at least one heat pipe. The radiating fins are formed with multiple holes. The most often used measure for assembling the heat pipe with the radiating fins is to pass the heat pipe through the holes one by one to connect the heat pipe with the radiating fins. Such process is troublesome and complicated. Therefore, the assembling efficiency is poorer.

According to the above, the conventional heat pipe heat sink structure has the following shortcomings:

1. The assembling efficiency is poorer.
2. The assembling process is complicated.

SUMMARY OF THE INVENTION

It is therefore a primary object of the present invention to provide a method of assembling thermal module. By means of the method, the assembling efficiency is greatly increased.

It is a further object of the present invention to provide the above method of assembling thermal module. By means of the method, the manufacturing process of the thermal module is simplified.

To achieve the above and other objects, the method of assembling thermal module o the present invention includes steps of providing a first heat dissipation member and a second heat dissipation member, and aiming a section of the first heat dissipation member at a section of the second heat dissipation member, which section of the first heat dissipation member is to be assembled with the section of the second heat dissipation member and driving the first heat dissipation member to connect with the second heat dissipation member by means of striking the first heat dissipation member into the second heat dissipation member. According to the method of assembling the thermal module of the present invention, the first heat dissipation member is connected with the second heat dissipation member by means of striking. Therefore, the thermal module can be assembled at much higher efficiency. Moreover, the manufacturing process of the thermal module is simplified.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
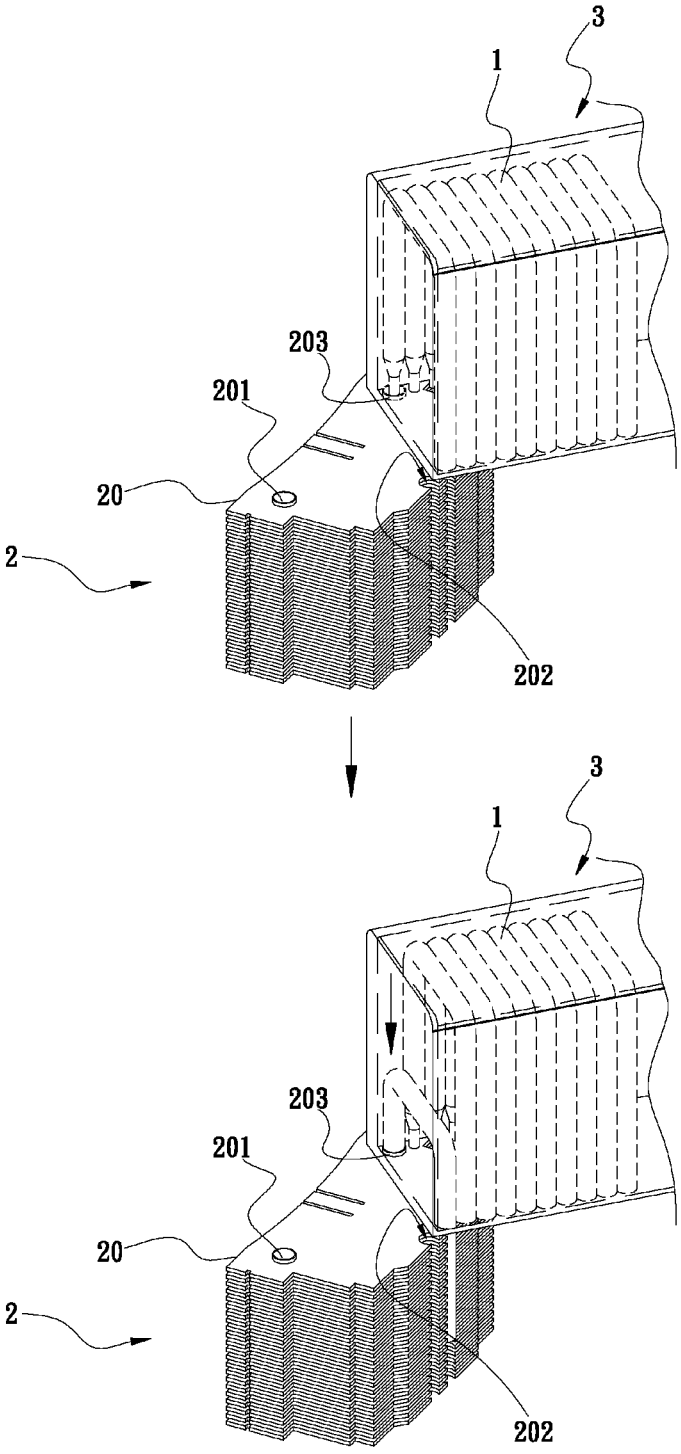
FIG. 1A is a perspective view showing a first embodiment of the method of assembling thermal module of the present invention.
Figure 1B:
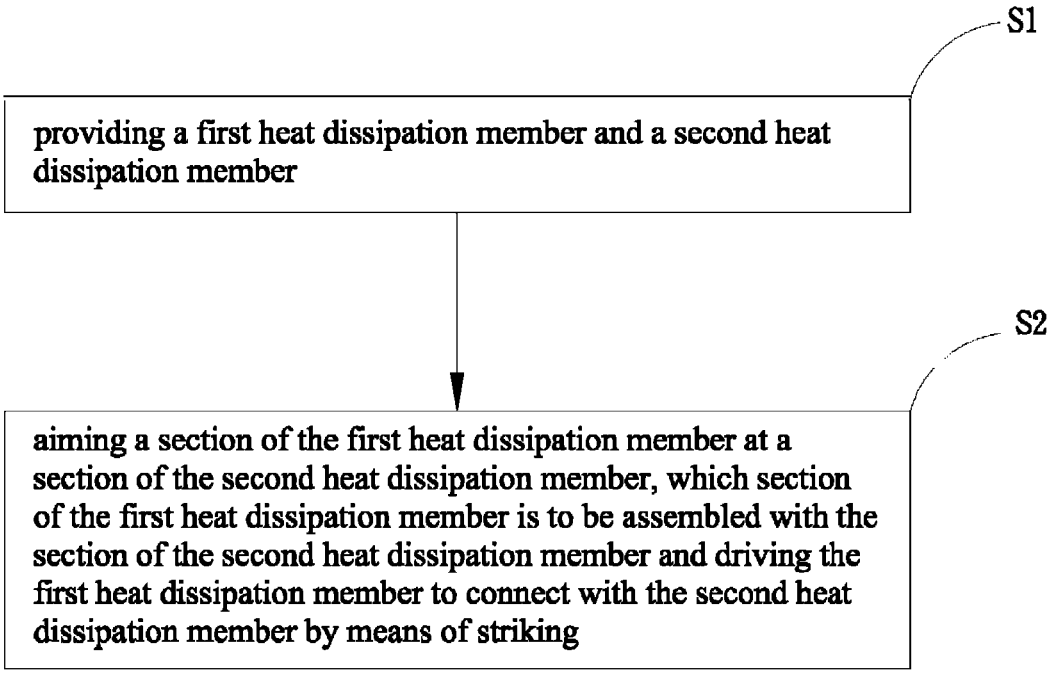
FIG. 1B is a flow chart of the first embodiment of the method of assembling thermal module of the present invention.

Please refer to FIGS. 1A and 1B. FIG. 1A is a perspective view showing a first embodiment of the method of assembling thermal module of the present invention. FIG. 1B is a flow chart of the first embodiment of the method of assembling thermal module of the present invention. According to the first embodiment, the method of assembling thermal module of the present invention includes:

step S1: providing a first heat dissipation member and a second heat dissipation member, a first heat dissipation member 1 and a second heat dissipation member 2 being provided, the second heat dissipation member 2 being a heat sink or a radiating fin assembly, the second heat dissipation member 2 having multiple radiating fins 20, each of the radiating fins 20 being preformed with a first hole 201 and a first notch 202, the first holes 201 and the first notches 202 of the radiating fins 20 being aligned with each other, the first heat dissipation member 1 being a heat pipe, the heat pipe being previously bent into a U-shape, two ends of the first heat dissipation member 1 being respectively corresponding to the first holes 201 and the first notches 202 of the second heat dissipation member 2, a hub section 203 being formed on a circumference of the first hole 201; and step S2: aiming a section of the first heat dissipation member at a section of the second heat dissipation member, which section of the first heat dissipation member is to be assembled with the section of the second heat dissipation member and driving the first heat dissipation member to connect with the second heat dissipation member by means of striking the first heat dissipation member into the second heat dissipation member, a section of the first heat dissipation member 1 being aimed at a section of the second heat dissipation member 2, which section of the first heat dissipation member 1 is to be assembled with the section of the second heat dissipation member 2, then the first heat dissipation member 1 being driven to tightly connect with the second heat dissipation member 2 by means of striking the first heat dissipation member 1 into the second heat dissipation member.

The first heat dissipation member 1 is received in a striking device 3. The striking device 3 serves to apply an action force to the first heat dissipation member 1 to push (or drive) the first heat dissipation member 1 out of the striking device 3. The action force can be in the form of spring force, pneumatic force, hydraulic force or explosion force. Two ends of the first heat dissipation member 1 are driven to respectively pass through the first holes 201 and the first notches 202 of the second heat dissipation member 2 to connect with the second heat dissipation member 2.

According to the method of assembling thermal module of the present invention, the first heat dissipation member 1 is received in the striking device 3. The striking device 3 is able to quickly push the first heat dissipation member 1 out of the striking device 3 by means of striking the first heat dissipation member 1. Accordingly, the first heat dissipation member 1 can be assembled with the second heat dissipation member 2 at higher efficiency. Moreover, the manufacturing process of the thermal module is simplified.

Figure 2:
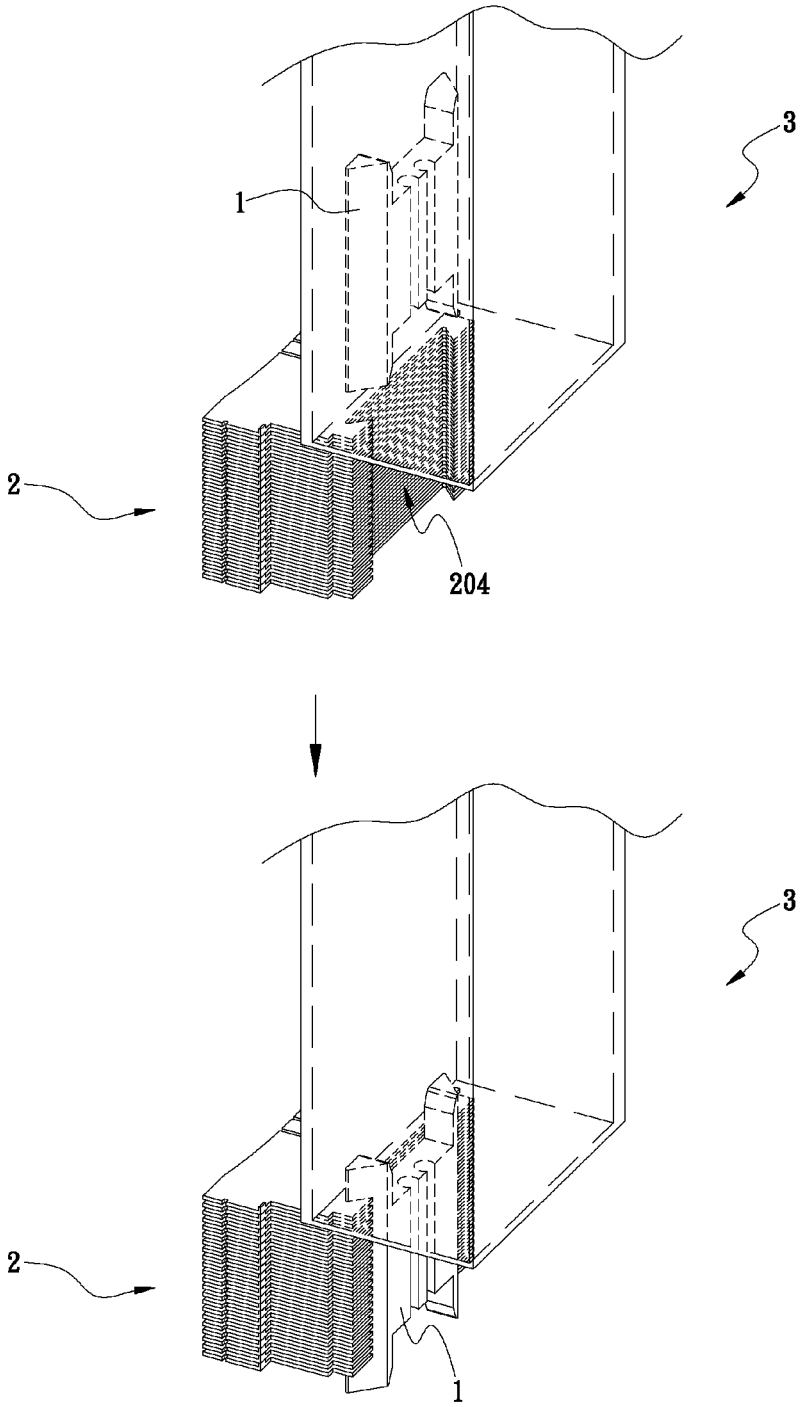
FIG. 2 is a perspective view showing a second embodiment of the method of assembling thermal module of the present invention.

Please now refer to FIG. 2, which is a perspective view showing a second embodiment of the method of assembling thermal module of the present invention. The second embodiment is partially identical to the first embodiment in step and thus will not be repeatedly described hereinafter. The second embodiment is different from the first embodiment in that the second heat dissipation member 2 is a heat sink preformed with a recess 204 on one side. The first heat dissipation member 1 is a heat conduction substrate. The striking device 3 serves to apply an action force to the first heat dissipation member 1 to drive the first heat dissipation member 1 into the recess 204 of the second heat dissipation member 2 so as to connect the first heat dissipation member 1 with the second heat dissipation member 2. The action force can be in the form of spring force, pneumatic force, hydraulic force or explosion force. Accordingly, the first heat dissipation member 1 can be assembled with the second heat dissipation member 2 at higher efficiency. Moreover, the manufacturing process of the thermal module is simplified.

Figure 3:
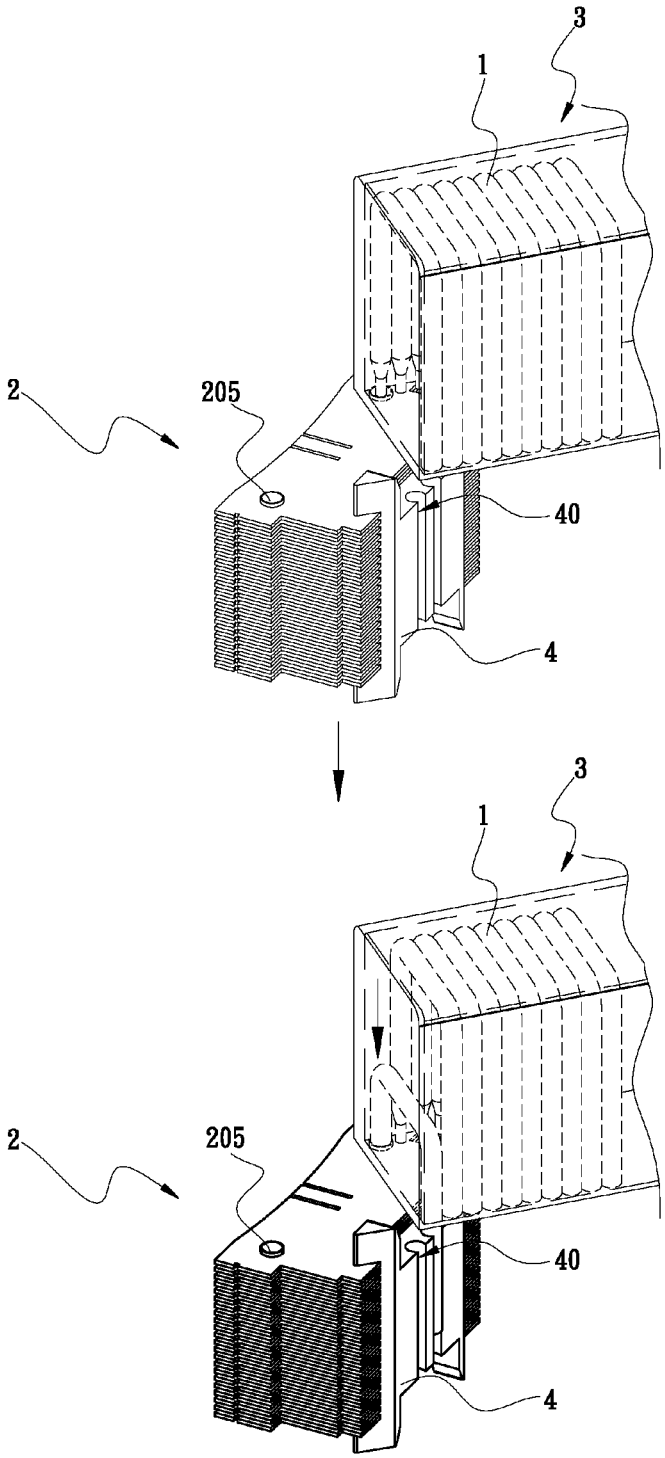
FIG. 3 is a perspective view showing a third embodiment of the method of assembling thermal module of the present invention.

Please now refer to FIG. 3, which is a perspective view showing a third embodiment of the method of assembling thermal module of the present invention. The third embodiment is partially identical to the first embodiment in step and thus will not be repeatedly described hereinafter. The third embodiment is different from the first embodiment in that the thermal module further includes a third heat dissipation member 4, which is a heat conduction substrate preformed with a channel 40. The second heat dissipation member 2 is a heat sink or a radiating fin assembly. The second heat dissipation member 2 is preformed with a hole 205. The first heat dissipation member 1 is a heat pipe previously bent into a U-shape. After the third heat dissipation member 4 is assembled with the second heat dissipation member 2, the striking device 3 applies an action force in any of the above forms to the first heat dissipation member 1 to strike and drive the first heat dissipation member 1 out of the striking device 3. Two ends of the first heat dissipation member 1 are driven to respectively pass through the holes 205 of the second heat dissipation member 2 and the channel 40 of the third heat dissipation member 4 to connect with the second and third heat dissipation members 2, 4. Accordingly, the assembling efficiency is increased.

Figure 4:
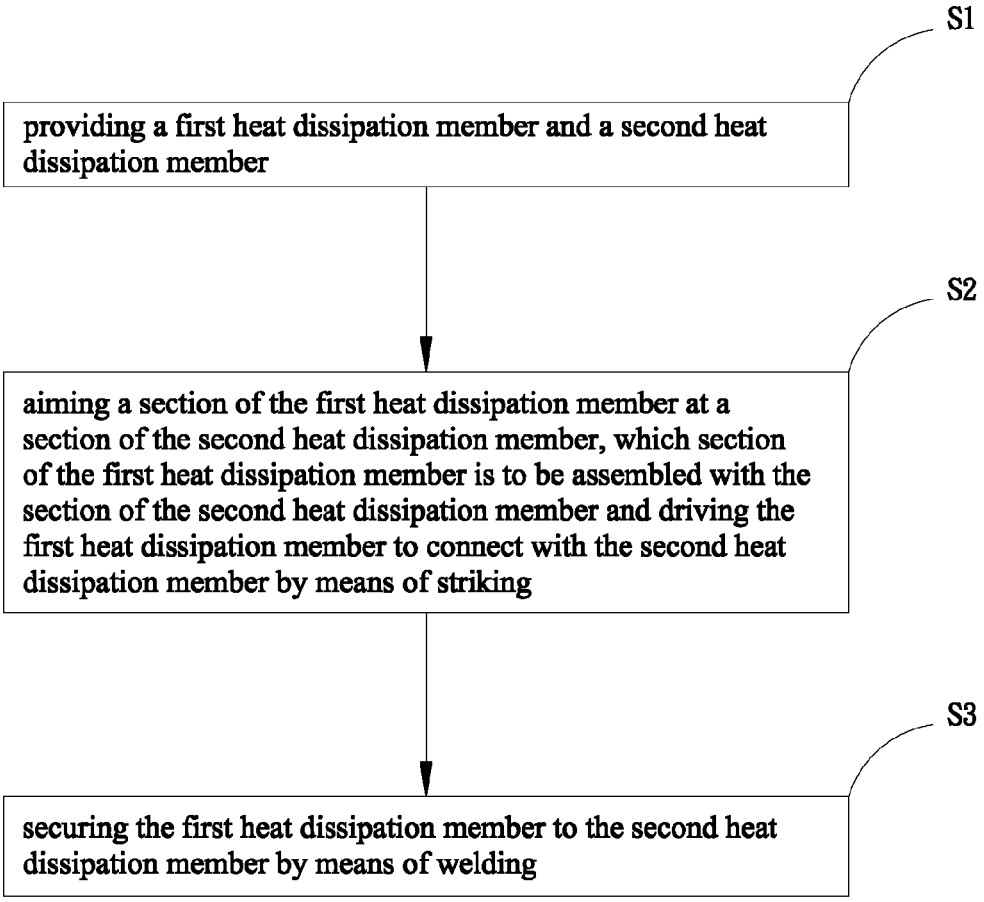
FIG. 4 is a flow chart of a fourth embodiment of the method of assembling thermal module of the present invention.

Please now refer to FIG. 4 as well as FIG. 1A. FIG. 4 is a flow chart of a fourth embodiment of the method of assembling thermal module of the present invention. The fourth embodiment is partially identical to the first embodiment in step and thus will not be repeatedly described hereinafter. The fourth embodiment is different from the first embodiment in that the fourth embodiment further includes a step S3 of securing the first heat dissipation member to the second heat dissipation member by means of welding after step S2 of aiming the first heat dissipation member at the second heat dissipation member and driving the first heat dissipation member to connect with the second heat dissipation member by means of striking.

In step S3, the first heat dissipation member is secured to the second heat dissipation member by means of welding.

Finally, the first heat dissipation member 1 is secured to the second heat dissipation member 2 by means of welding.

After the first heat dissipation member 1 is connected to the second heat dissipation member 2 by means of striking, the first heat dissipation member 1 is further secured to the second heat dissipation member 2 by means of welding. Accordingly, the first heat dissipation member 1 can be assembled with the second heat dissipation member 2 at higher efficiency. Moreover, the manufacturing process of the thermal module is simplified.

In conclusion, in comparison with the conventional technique, the present invention has the following advantages:

1. The assembling efficiency is increased.
2. The manufacturing process is simplified.

The present invention has been described with the above embodiments thereof and it is understood that many changes and modifications in the above embodiments can be carried out without departing from the scope and the spirit of the invention that is intended to be limited only by the appended claims.

What is claimed is:

1. A method of assembling a thermal module, comprising steps of:

providing a U-shaped heat pipe and a second heat dissipation member, wherein the U-shaped heat pipe is received in a striking device; and aiming a section of the U-shaped heat pipe at a section of the second heat dissipation member, which section of the U-shaped heat pipe is to be assembled with the section of the second heat dissipation member and driving the U-shaped heat pipe to connect with the second heat dissipation member by means of striking the U-shaped heat pipe from the striking device into the second heat dissipation member, the striking device serving to apply an action force to the U-shaped heat pipe to push the U-shaped heat pipe out of the striking device, the action force being in the form of spring force, pneumatic force, hydraulic force or explosion force.

2. The method of assembling thermal module as claimed in claim 1, wherein the second heat dissipation member is a heat sink or a radiating fin assembly, the second heat dissipation member having multiple radiating fins, each of the radiating fins being preformed with a first hole and a first notch, the first holes and the first notches of the radiating fins being aligned with each other, two ends of the U-shaped heat pipe being respectively corresponding to the first holes and the first notches of the second heat dissipation member.

3. The method of assembling thermal module as claimed in claim 2, wherein a hub section is formed on a circumference of the first hole.

4. The method of assembling thermal module as claimed in claim 2, wherein two ends of the U-shaped heat pipe are driven to respectively pass through the first holes and the first notches of the second heat dissipation member to connect with the second heat dissipation member.

5. The method of assembling thermal module as claimed in claim 1, wherein the thermal module further includes a third heat dissipation member, which is a heat conduction substrate preformed with a channel, the second heat dissipation member being a heat sink or a radiating fin assembly, the second heat dissipation member being preformed with a hole.

6. The method of assembling thermal module as claimed in claim 5, wherein two ends of the U-shaped heat pipe are driven to respectively pass through the hole of the second heat dissipation member and the channel of the third heat dissipation member to connect with the second and third heat dissipation members.

7. The method of assembling thermal module as claimed in claim 1, further comprising a step of securing the U-shaped heat pipe to the second heat dissipation member by means of welding.

* * * * *